US011584586B2

(12) United States Patent
Oh et al.

(10) Patent No.: US 11,584,586 B2
(45) Date of Patent: Feb. 21, 2023

(54) STORAGE CONTAINER DRAIN

(71) Applicant: WERNER CO., Greenville, PA (US)

(72) Inventors: Sang Oh, Lake Zurich, IL (US); Michael Gong, Elk Grove Village, IL (US); Robert A. Bergum, Woodstock, IL (US); Jose R. Rodriguez, Village of Lakewood, IL (US)

(73) Assignee: WERNER CO., Greenville, PA (US)

( * ) Notice: Subject to any disclaimer, the term of this patent is extended or adjusted under 35 U.S.C. 154(b) by 0 days.

(21) Appl. No.: 17/495,147

(22) Filed: Oct. 6, 2021

(65) Prior Publication Data

US 2022/0106108 A1 Apr. 7, 2022

Related U.S. Application Data

(60) Provisional application No. 63/088,608, filed on Oct. 7, 2020.

(51) Int. Cl.
*B65D 88/74* (2006.01)

(52) U.S. Cl.
CPC ..... *B65D 88/747* (2013.01)

(58) Field of Classification Search
CPC ..... B65D 2251/1058; B65D 43/167; B65D 90/008; B25H 1/12; B25H 3/00; B25H 1/20
See application file for complete search history.

(56) References Cited

U.S. PATENT DOCUMENTS

| | | | | |
|---|---|---|---|---|
| 3,387,734 | A | 6/1968 | Turpen | |
| 3,613,044 | A * | 10/1971 | Rarick | H01R 13/72 174/67 |
| 4,351,230 | A | 9/1982 | Brickner et al. | |
| 4,386,700 | A | 6/1983 | Deaton | |
| 4,517,882 | A | 5/1985 | Watanabe et al. | |
| 4,674,665 | A | 6/1987 | Van Kirk | |
| 5,428,968 | A | 7/1995 | Fetsukawa et al. | |
| 5,431,492 | A | 7/1995 | Rothschild et al. | |

(Continued)

FOREIGN PATENT DOCUMENTS

| | | | |
|---|---|---|---|
| CA | 2700005 | A1 | 10/2011 |
| CN | 201455960 | U | 5/2010 |

(Continued)

OTHER PUBLICATIONS

Blain's Farm & Fleet, "Delta—Jobsite Truck Box," https://www.farmandfleet.com/products/780309-delta-jobsite-truck-box.html, retrieved from the internet on Feb. 9, 2020.

(Continued)

*Primary Examiner* — Shawn M Braden
(74) *Attorney, Agent, or Firm* — McDonnell Boehnen Hulbert & Berghoff LLP

(57) ABSTRACT

A storage container with a drain feature is disclosed. In one embodiment, the storage container includes an inner compartment having a top wall, a bottom wall, and two side walls, a vertical post extending from the bottom wall, the vertical post having at least one opening formed on a front side, and at least one latch rod formed on a back side, and a drain feature positioned the back side of the vertical post, the drain feature including a guard, a ramp, and a sump. The drain feature interacts with the at least one latch rod.

20 Claims, 5 Drawing Sheets

(56) References Cited

U.S. PATENT DOCUMENTS

| | | | | |
|---|---|---|---|---|
| 5,546,758 | A | 8/1996 | Hintermeier | |
| 5,685,467 | A | 11/1997 | Niemi et al. | |
| 6,050,660 | A | 4/2000 | Gurley | |
| 6,059,387 | A | 5/2000 | Echard et al. | |
| 6,102,498 | A | 8/2000 | Kohler et al. | |
| 6,167,922 | B1 | 1/2001 | Seitz et al. | |
| 6,513,889 | B1 | 2/2003 | Park | |
| 6,772,566 | B1 * | 8/2004 | Machledt | H02G 9/10 52/36.2 |
| 7,431,368 | B2 | 10/2008 | Henderson et al. | |
| 7,931,324 | B2 | 4/2011 | Henderson et al. | |
| 8,061,395 | B1 | 11/2011 | Atkinson | |
| 8,172,344 | B2 | 5/2012 | Eyer et al. | |
| 8,177,387 | B2 | 5/2012 | Noda et al. | |
| 8,181,811 | B1 | 5/2012 | Blake | |
| 8,317,274 | B2 | 11/2012 | Hsiao | |
| 8,490,809 | B2 | 7/2013 | Cadiente et al. | |
| 9,085,267 | B2 | 7/2015 | Malin | |
| 9,108,758 | B2 | 8/2015 | Brennan, Jr. | |
| 9,580,237 | B2 | 2/2017 | Nolan et al. | |
| 9,688,214 | B1 | 6/2017 | Moore | |
| 9,783,129 | B2 | 10/2017 | Roach et al. | |
| 9,821,954 | B2 | 11/2017 | Clive-Smith et al. | |
| 9,962,825 | B2 | 5/2018 | Gonzales et al. | |
| 10,071,275 | B2 | 9/2018 | Beaver et al. | |
| 10,448,736 | B2 | 10/2019 | Vanliefde et al. | |
| 2005/0103783 | A1 | 5/2005 | Bergum et al. | |
| 2005/0180833 | A1 | 8/2005 | Almind | |
| 2007/0069613 | A1 | 3/2007 | DiNota et al. | |
| 2010/0237076 | A1 * | 9/2010 | Kirby | B65D 43/24 220/315 |
| 2010/0264180 | A1 | 10/2010 | Allotey | |
| 2012/0242208 | A1 | 9/2012 | Eyer et al. | |
| 2012/0261450 | A1 | 10/2012 | Moore | |
| 2015/0158172 | A1 | 6/2015 | Conway et al. | |
| 2019/0029418 | A1 | 1/2019 | Herzberg et al. | |

FOREIGN PATENT DOCUMENTS

| | | | |
|---|---|---|---|
| DE | 202013003741 | U1 | 4/2013 |
| EP | 0040993 | A1 | 12/1981 |
| GB | 2175284 | A | 11/1986 |
| GB | 2523078 | A | 8/2015 |
| WO | 96/32333 | A1 | 10/1996 |

OTHER PUBLICATIONS

JOBOX, Premium Storage Solutions, Product Catalog, 2017.

* cited by examiner

STORAGE CONTAINER DRAIN

CROSS REFERENCE TO RELATED APPLICATIONS

The present application claims priority to U.S. Provisional Patent Application No. 63/088,608, filed Oct. 7, 2020 which is herewith incorporated by reference into the present application.

BACKGROUND

A. Field

This disclosure relates generally to storage containers, and more particularly to a storage container having an integrated drain.

B. Description of Related Art

Jobsite storage boxes and containers are often placed and used in outdoor environments. These storage products are constantly subjected to rain and snow over the life of the product. Any liquid intruding inside of the storage box will damage hand tools, power tools, equipment, and any other materials such as paper or drawings stored inside of the unit.

One avenue for water to potentially intrude is via an opening in the container through which the lid latch actuator handle, or lock lever, protrudes. This actuator could be located on the cabinet door lid or on any side of the storage container body. Thus, a need exists for a feature to prevent any liquid, such as rain water and melted snow, which might enter around the actuator handle opening, from entering further into the storage container.

SUMMARY

The following embodiments and aspects thereof are described and illustrated in conjunction with systems, tools and methods which are meant to be exemplary and illustrative, not limiting in scope.

In one aspect, a storage container having a drain is disclosed. The storage container includes an inner compartment having a top wall, a bottom wall, and two side walls, a vertical post extending from the bottom wall, the vertical post having at least one opening formed on a front side, and at least one latch rod formed on a back side, and a drain feature positioned the back side of the vertical post, the drain feature including a guard, a ramp, and a sump. The drain feature interacts with the at least one latch rod.

In addition to the exemplary aspects and embodiments described above, further aspects and embodiments will become apparent by reference to the drawings and by study of the following detailed description.

BRIEF DESCRIPTION OF THE DRAWINGS

Exemplary embodiments are illustrated in the drawings. It is intended that the embodiments and figures disclosed herein are to be considered illustrative rather than restrictive.

DETAILED DESCRIPTION

A storage cabinet or container having a drain feature disclosed. In one embodiment, the drain feature includes a structure that forms an internal gutter system, a water collection sump, and a flow direction path to expel water outside of the unit. The system is located so as to drain water which might enter through openings in the unit which are required for lid latch actuator handles. The water is routed out of the container through the drain, and thus the contents inside the container are kept dry. In some embodiments, the drain is integral with the latching mechanism of the container.

Figure 1:
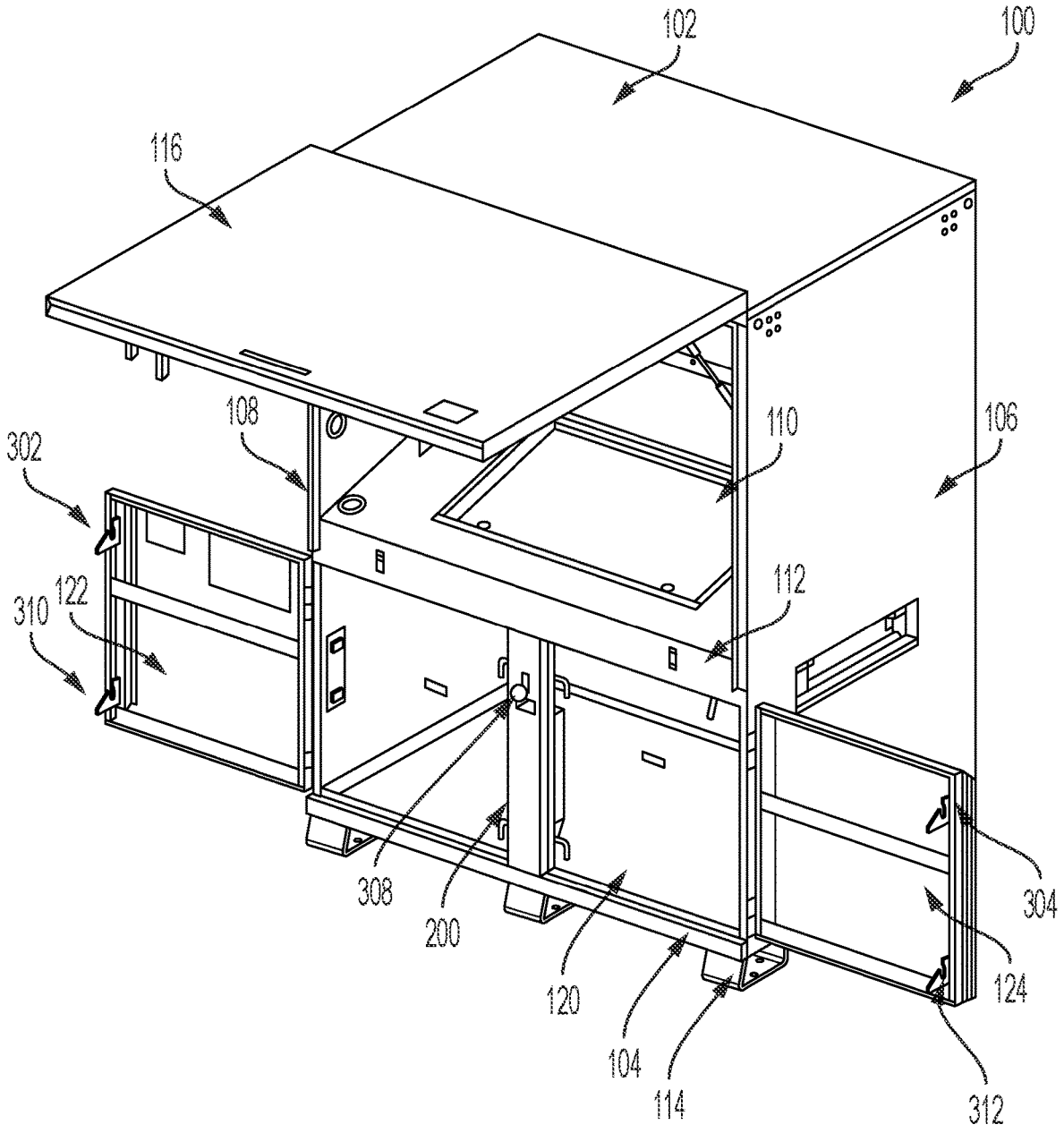
FIG. 1 is a perspective view of an example storage container with a drain in accordance with an embodiment.
Figure 2:
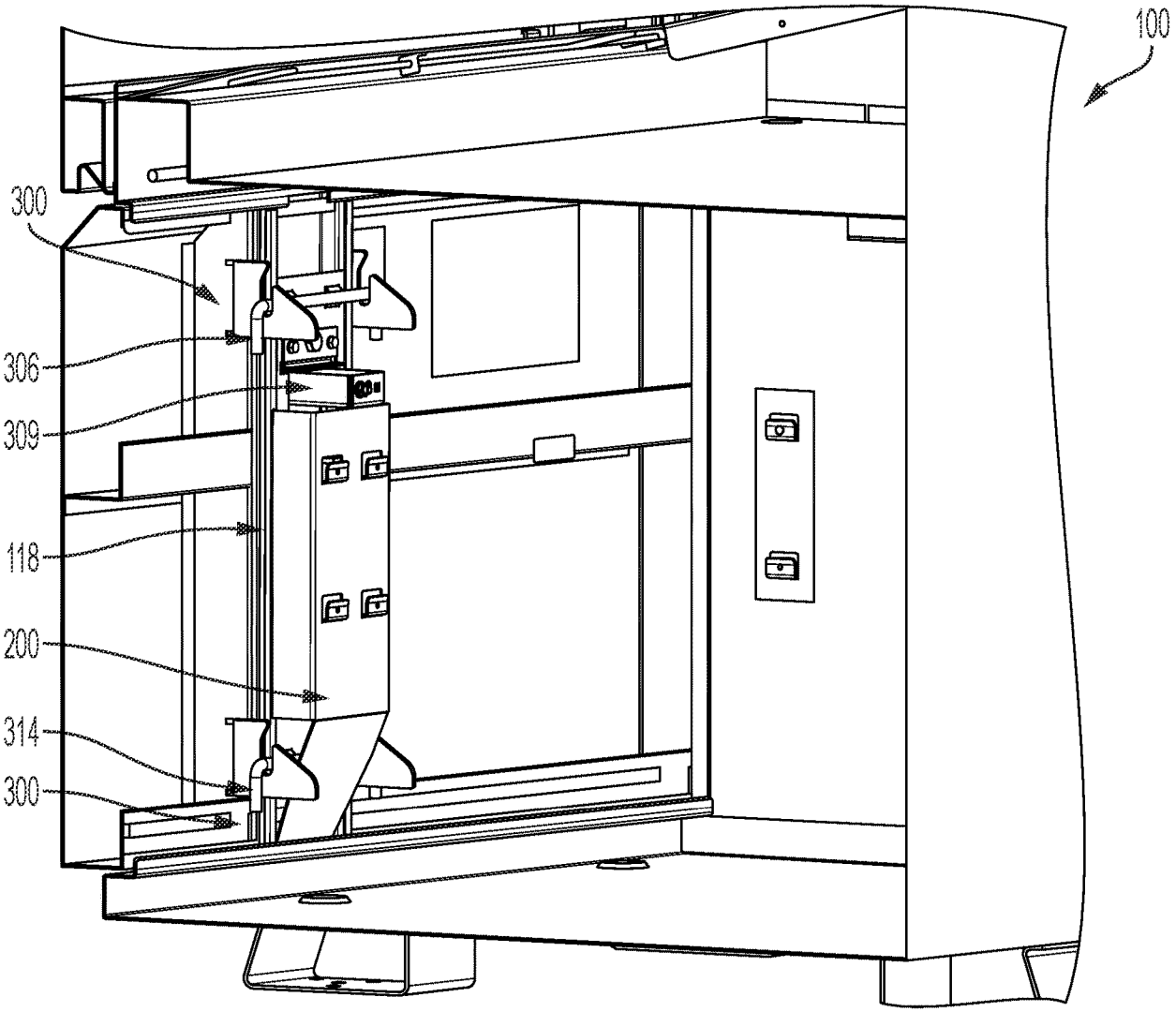
FIG. 2 is a close up view of the interior of the storage container shown in FIG. 1.

Referring to FIGS. 1 and 2, an example storage container or cabinet 100 having a drain 200 is disclosed. In some embodiments, the storage container 100 includes a top wall 102, a bottom wall 104, and side walls 106, 108. In some embodiments, the storage container 100 has at least two compartments: a first compartment 110, which may be an upper compartment, and a second compartment 120, which may be a lower compartment. The first and second compartments 110, 120 may be separated by a horizontal member 112. The horizontal member 112 functions as the bottom wall of the upper compartment 110 and the upper wall of the lower compartment 120. It should be understood that the first and second compartments 110, 120 may be configured to store tools and other equipment, as well as to accommodate a number of electronic components such as, for example, a flat screen television or monitor, a computer, a printer, a keyboard, and a mouse. The location of each component in the storage container 100 may vary depending upon the needs of the contractor or tradesperson. The storage container 100 may also include one or more feet 114 adjacent the bottom wall 104.

In some embodiments, the first compartment 110 may include a door 116 moveable between an open position and a closed position via a hinge. It should be understood that in alternate embodiments, the first compartment 110 may include more than one door. In some embodiments, the door 116 may include a locking mechanism (not shown) to lock and unlock the door.

The second compartment 120 may include a vertical post 118 (shown in FIG. 2). In some embodiments, the vertical post 118 may be positioned in the center of the second compartment 120. The vertical post 118 has a front side 115 which faces the exterior of the storage container 100 and a back side 117 which faces an interior of the storage container 100. In some embodiments, the vertical post 118 includes an opening or window 119 to provide access to a locking mechanism, such as a padlock (not shown).

The second compartment 120 may also include at least one door moveable between an open position and a closed position. As shown in FIG. 1, the second compartment 120 has a first door 122 and a second door 124, which both connect to the vertical post 118. The vertical post 118 further includes a latching mechanism 300 (best seen in FIG. 2) for retaining the doors 122, 124 of the second compartment 120 in the closed position. The latching mechanism 300 is moveable between a latched position in which the contents of the second compartment 120 may not be accessed, and an unlatched position in which the contents of the second compartment 120 may be accessed.

In some embodiments, the latching mechanism 300 includes a first upper catch 302 secured to an interior of the first door 122, and a second upper catch 304 secured to an interior of the second door 124. An upper latch rod 306 secured to the vertical post 118 is configured to extend through the upper catches 302, 304 when the latching mechanism 300 is in the locked position. An actuator 308, such as a handle or knob, is configured to move within an aperture 307 on the vertical post 118 between a first position and a second position to lock and unlock the latching mechanism 300, as described in more detail below.

Similarly, the latching mechanism 300 includes a first lower catch 310 secured to an interior of the first door 122, and a second lower catch 312 secured to an interior of the second door 124. A lower latch rod 314 secured to the vertical post 118 extends through the lower catches 310, 312 when the latching mechanism 300 is in the locked position.

The vertical post 118 further includes a lock box 309 which houses a lock, which may be a conventional padlock (not shown) having a padlock body with a key insertion surface on the bottom, and a shackle.

In operation, to unlock the second compartment 120 and unlatch the latching mechanism 300, a user unlocks the padlock and pulls the actuator 308 upward toward the horizontal member 112 to disengage the upper latch rod 306 from the first and second upper catches 302 and 304 and to disengage the lower latch rod 314 from the first and second lower catches 310, 312. With the upper and lower catches disengaged from the upper and lower latch rods, respectively, the first and second doors 122, 124 can be moved to the open position.

To re-latch the doors 122, 124, the user pulls the actuator 308 in a downward direction, toward the bottom wall 104, once the doors are in the closed position. This movement engages the upper latch rod 306 with the first and second upper catches 302 and 304, and the lower latch rod 314 from the first and second lower catches 310, 312. The user then locks the padlock. Thus, the second compartment is locked and the doors cannot be opened.

Figure 4:
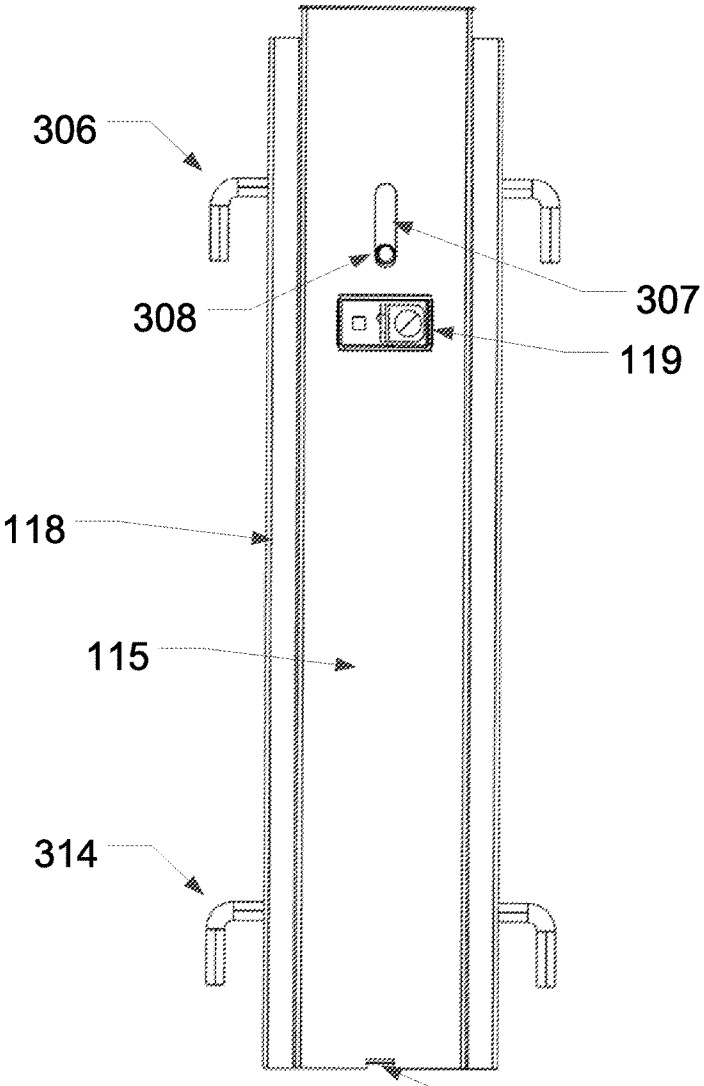
FIG. 4 is a front view of the drain shown in FIG. 3.
Figure 3:
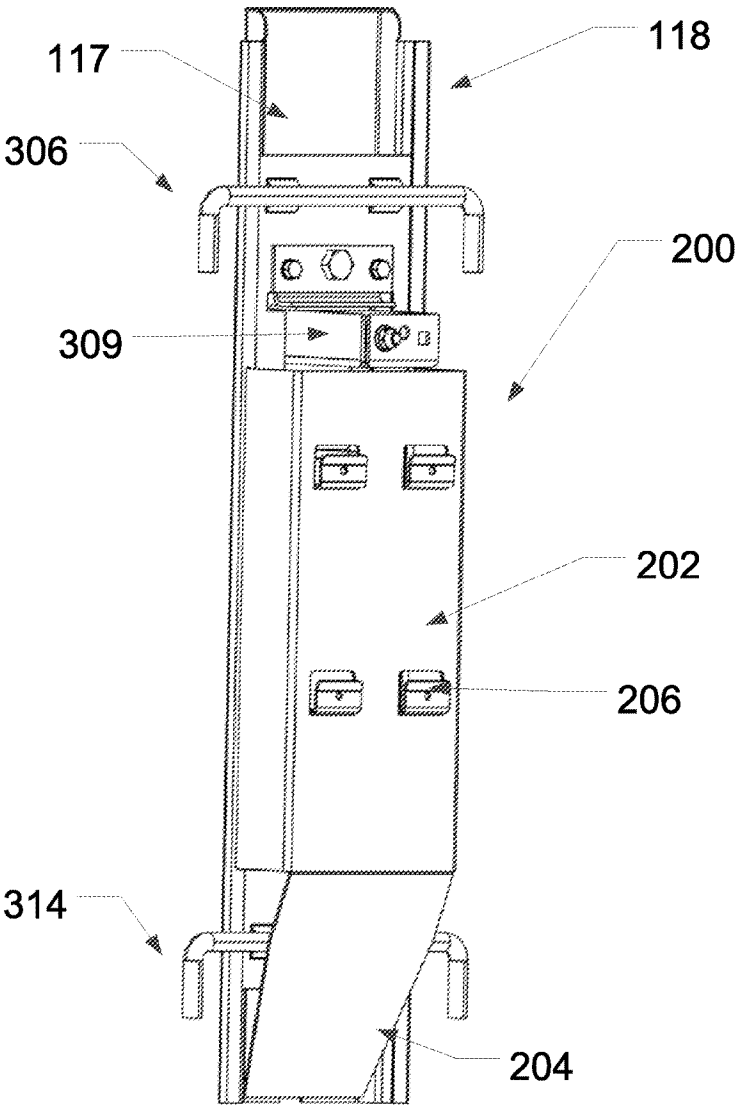
FIG. 3 is a rear perspective view of the drain in accordance with an embodiment.
Figure 5:
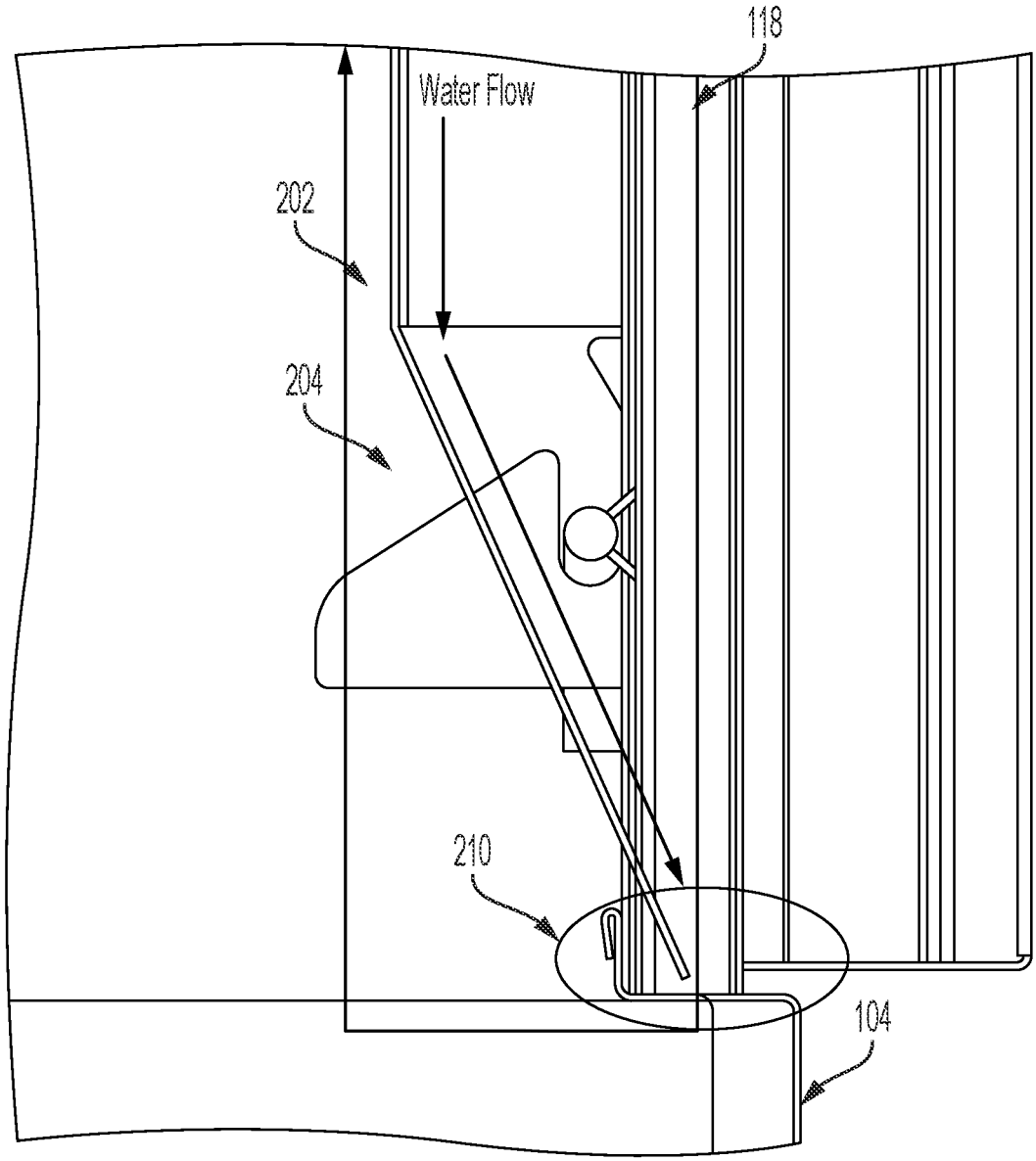
FIG. 5 is a side view of a lower section of the drain shown in FIG. 3.
Figure 6:
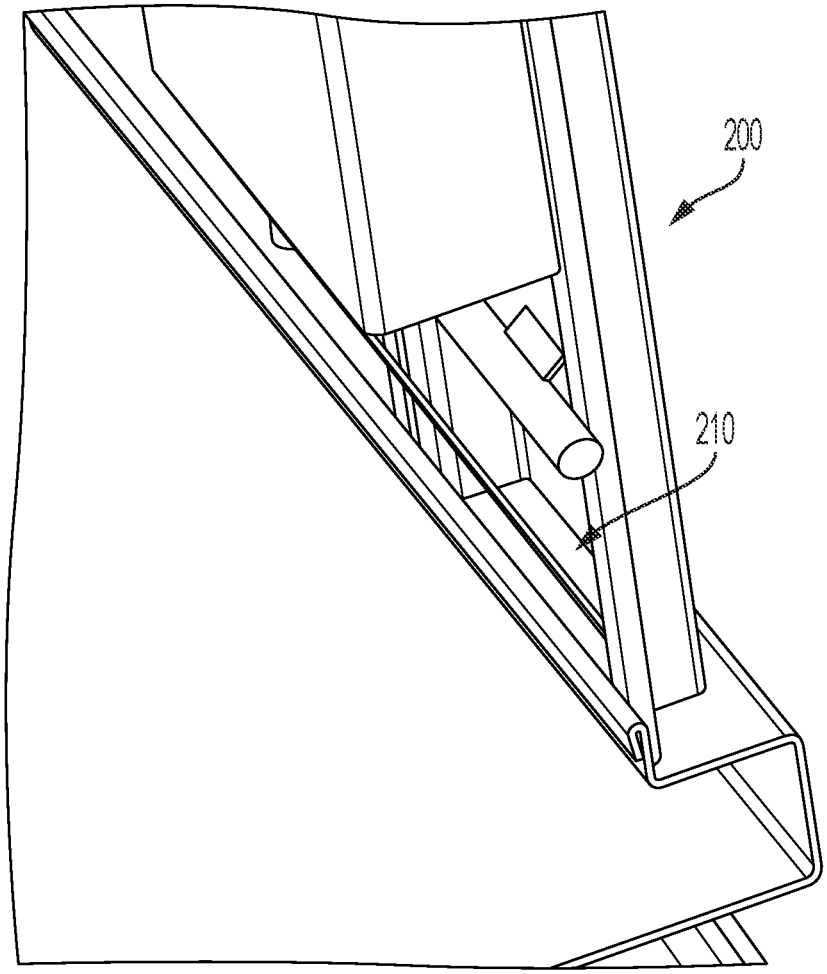
FIG. 6 is a close-up view of a rear lower portion of the drain.

FIGS. 3 and 4 show a drain 200. As mentioned above, the drain 200 provides an outlet for liquid that might otherwise flow into the container 100. The drain 200 is positioned on the vertical post 118, and located between each pair of catches, i.e., upper catches 302, 304 and lower catches 310, 312. In some embodiments, the drain 200 includes a guard 202 and a ramp 204. The guard 202 has a hollow interior serving as a gutter through which liquid may flow. The ramp 204 controls the direction of the liquid flowing therethrough. In some embodiments, the guard 202 and the ramp 204 are formed on the back side 117 of the vertical post 118, and may interact with at least some portions of the latching mechanism 300. For example, as shown in FIGS. 3 and 5, the ramp 204 is positioned over the lower latch rod 314. In this position, the ramp 204 and the lower latch rod 314 overlap. In FIGS. 3 and 5, latch rod 314 is shown to extend through the space between the ramp 204 and the vertical post 118.

In some embodiments, the guard 202 may further include one or more tabs 206 on which one or more adjustable shelves (not shown) may be placed.

As shown in FIG. 4, the vertical post 118 further includes a drain hole 208 through which the liquid can flow to the exterior of the storage container 100. Although the drain hole 208 is shown having a generally rectangular shape, it should be understood that the drain hole 208 may take alternative shapes.

FIG. 5 shows a side view of the drain 200. In some embodiments, an integrated sump 210 is positioned at the bottom end of the drain, near the bottom wall 104 of the storage container 100, where liquid, such as water, can collect. The sump 210 is the collection point of the any water that traveled through the guard 202 and ramp 204. The sump 210 is isolated from the internal compartment so that liquid/water will be contained within the sump 210 and not protrude into the internal compartments where tools and/or construction materials are stored.

In operation, when liquid intrudes into the interior of the storage container 100 through the aperture 307 or opening 119 in the vertical post 118, the liquid flows down through the interior of the guard 202 and along the ramp 204, as shown by the arrows in FIG. 5. The liquid can then collect at the sump 210 and flow to the exterior of the storage container 100 through the drain hole 208.

In other embodiments, the storage container 100 may have only one inner compartment and the vertical post 118 may extend the entire length of the storage container.

The present application provides a number of advantages, including the elimination of a physical cover outside any openings, slots, or windows on the box which may be present for any moving handles etc., which actuate internal mechanisms from outside of the product.

While a number of exemplary aspects and embodiments have been discussed above, those of skill in the art will recognize that still further modifications, permutations, additions and sub-combinations thereof of the features of the disclosed embodiments are still possible. It is therefore intended that the following appended claims and claims hereafter introduced are interpreted to include all such modifications, permutations, additions and sub-combinations as are within their true spirit and scope.

The invention claimed is:

1. A storage container comprising:

an inner compartment having a top wall, a bottom wall, and two side walls;

a vertical post extending from the bottom wall, the vertical post having at least one opening formed on a front side, and at least one latch rod formed on a back side; and a drain positioned the back side of the vertical post, the drain including a guard, a ramp, and a sump;

wherein the drain interacts with the at least one latch rod.

2. The storage container of claim 1, wherein the vertical post includes a latching mechanism having an upper latch rod and a lower latch rod, and wherein the drain interacts with the lower latch rod.

3. The storage container of claim 2, wherein the ramp is positioned over the lower latch rod, with the lower latch rod extending through space between the ramp and the vertical post.

4. The storage container of claim 1, wherein the vertical post further includes a hole configured to allow liquid to flow outside of the storage container.

5. The storage container of claim 1, wherein the sump is positioned at a bottom end of the drain and is configured to collect liquid.

6. The storage container of claim 1, further comprising a first compartment and a second compartment separated by a horizontal member.

7. The storage container of claim 6, wherein the second compartment includes first and second doors, with the vertical post being positioned between the first and second doors.

8. The storage container of claim 7, wherein the first door includes a first upper catch and a first lower catch, and the second door includes a second upper catch and a second lower catch, and wherein the upper latch rod engages the first and second upper catches and the lower latch rod engages the first and second lower catches when the first and second doors are in a closed position.

9. The storage container of claim 1, wherein the guard includes a plurality of tabs, the plurality of tabs being configured to hold a shelf.

10. The storage container of claim 1, wherein the vertical post further includes an opening configured to provide access to a locking mechanism.

11. The storage container of claim 10, wherein the locking mechanism includes a lock box and a lock.

12. The storage container of claim 1, wherein the vertical post further comprises an actuator configured to move the latching mechanism between an open position and a closed position.

13. A drain for use with a storage container, the drain comprising:

a guard having a hollow interior, the guard being configured to allow liquid to flow therethrough;

a ramp positioned below the guard; and a sump positioned at a bottom of the ramp;

wherein the drain is positioned on a vertical post of the storage container; and wherein the drain interacts with at least a portion of a latching mechanism positioned on the vertical post.

14. The drain of claim 13, wherein the drain is positioned below an upper latch rod on the vertical post.

15. The drain of claim 13, wherein the ramp is positioned over a lower latch rod on the vertical post, with the lower latch rod extending through space between the ramp and the vertical post.

16. The drain of claim 13, wherein the guard further comprises a plurality of tabs.

17. The drain of claim 13, wherein the sump is isolated from an internal compartment of the storage container.

18. The drain of claim 13, wherein the vertical post includes a hole configured to allow liquid to flow outside of the storage container.

19. The drain of claim 18, wherein the drain is configured to direct liquid to flow through the guard, down the ramp, into the sump, and out through the hole in the vertical post.

20. The drain of claim 13, wherein the storage container includes a first compartment and a second compartment, wherein the second compartment includes first and second doors, with the vertical post being positioned between the first and second doors, wherein the first door includes a first upper catch and a first lower catch, and the second door includes a second upper catch and a second lower catch, and wherein the upper latch rod engages the first and second upper catches and the lower latch rod engages the first and second lower catches when the first and second doors are in a closed position.

* * * * *